US010969706B2

(12) United States Patent
Sawamoto et al.

(10) Patent No.: US 10,969,706 B2
(45) Date of Patent: Apr. 6, 2021

(54) MAGNETIC CORE MATERIAL FOR ELECTROPHOTOGRAPHIC DEVELOPER, CARRIER FOR ELECTROPHOTOGRAPHIC DEVELOPER, AND DEVELOPER

(71) Applicant: POWDERTECH CO., LTD., Kashiwa (JP)

(72) Inventors: Hiroki Sawamoto, Kashiwa (JP); Tetsuya Uemura, Kashiwa (JP)

(73) Assignee: POWDERTECH CO., LTD., Kashiwa (JP)

( * ) Notice: Subject to any disclaimer, the term of this patent is extended or adjusted under 35 U.S.C. 154(b) by 0 days.

(21) Appl. No.: 16/483,709

(22) PCT Filed: Jan. 15, 2018

(86) PCT No.: PCT/JP2018/000875
§ 371 (c)(1),
(2) Date: Aug. 5, 2019

(87) PCT Pub. No.: WO2018/147001
PCT Pub. Date: Aug. 16, 2018

(65) Prior Publication Data

US 2020/0033746 A1 Jan. 30, 2020

(30) Foreign Application Priority Data

Feb. 10, 2017 (JP) ..... JP2017-023596

(51) Int. Cl.
*G03G 9/083* (2006.01)
*G03G 9/107* (2006.01)
(Continued)

(52) U.S. Cl.
CPC ..... *G03G 9/1075* (2013.01); *G03G 9/0834* (2013.01); *G03G 9/0838* (2013.01); *G03G 9/113* (2013.01); *H01F 1/36* (2013.01)

(58) Field of Classification Search
CPC .. G03G 9/1075; G03G 9/0834; G03G 9/0838; G03G 9/113; G03G 9/08;
(Continued)

(56) References Cited

U.S. PATENT DOCUMENTS 5,652,060 A 6/1997 Uchida et al.
2009/0246526 A1 10/2009 Sugiura et al.
(Continued)

FOREIGN PATENT DOCUMENTS

JP H09-059025 A 3/1997
JP M09-234839 10/2009
(Continued)

OTHER PUBLICATIONS

Translation of JP 2016-224237.*
(Continued)

*Primary Examiner* — Peter L Vajda
(74) *Attorney, Agent, or Firm* — Procopio, Cory, Hargreaves & Savitch LLP

(57) ABSTRACT

Provided are a magnetic core material for electrophotographic developer and a carrier for electrophotographic developer, which are excellent in charging characteristics and strength with low specific gravity and with which a satisfactory image free of defects can be obtained, and a developer containing the carrier.

A magnetic core material for electrophotographic developer, having a sulfur component content of from 60 to 800 ppm in terms of a sulfate ion and a pore volume of from 30 to 100 $mm^3/g$.

12 Claims, 1 Drawing Sheet

(51) Int. Cl.
*G03G 9/113* (2006.01)
*H01F 1/36* (2006.01)

(58) Field of Classification Search
CPC .... G03G 9/107; G03G 9/1085; G03G 9/0108; G03G 9/1087; G03G 9/10; H01F 1/36
See application file for complete search history.

(56) References Cited

U.S. PATENT DOCUMENTS

| | | | | |
|---|---|---|---|---|
| 2009/0263739 | A1 | 10/2009 | Sugiura et al. | |
| 2010/0055601 | A1 | 3/2010 | Sugiura et al. | |
| 2011/0212399 | A1 | 9/2011 | Suwa et al. | |
| 2012/0115078 | A1* | 5/2012 | Kinoshita | G03G 9/1133 430/106.1 |
| 2014/0287355 | A1 | 9/2014 | Sawamoto et al. | |
| 2014/0356782 | A1* | 12/2014 | Sugahara | G03G 9/1132 430/111.35 |
| 2019/0339628 | A1* | 11/2019 | Sawamoto | G03G 9/0835 |

FOREIGN PATENT DOCUMENTS

| | | | | |
|---|---|---|---|---|
| JP | 2010-055014 | A | 3/2010 | |
| JP | M11-180296 | | 9/2011 | |
| JP | 2013182064 | A | 9/2013 | |
| JP | 2014-197040 | | 10/2014 | |
| JP | 2016-025288 | A | 2/2016 | |
| JP | 2016-224237 | * | 12/2016 | G03G 9/107 |

OTHER PUBLICATIONS

International Search Report and Written Opinion for related International Application No. PCT/JP2018/000875, dated Apr. 17, 2018; English translation of ISR provided; 10 pages.
Office Action for related JP App. No. 2017023596 dated Jul. 28, 2020. English translation provided; 12 pages.
EESR from the EPO in the counterpart EP Patent Application No. 18751416.1, dated Oct. 20, 2020, Total 7 pages.

* cited by examiner

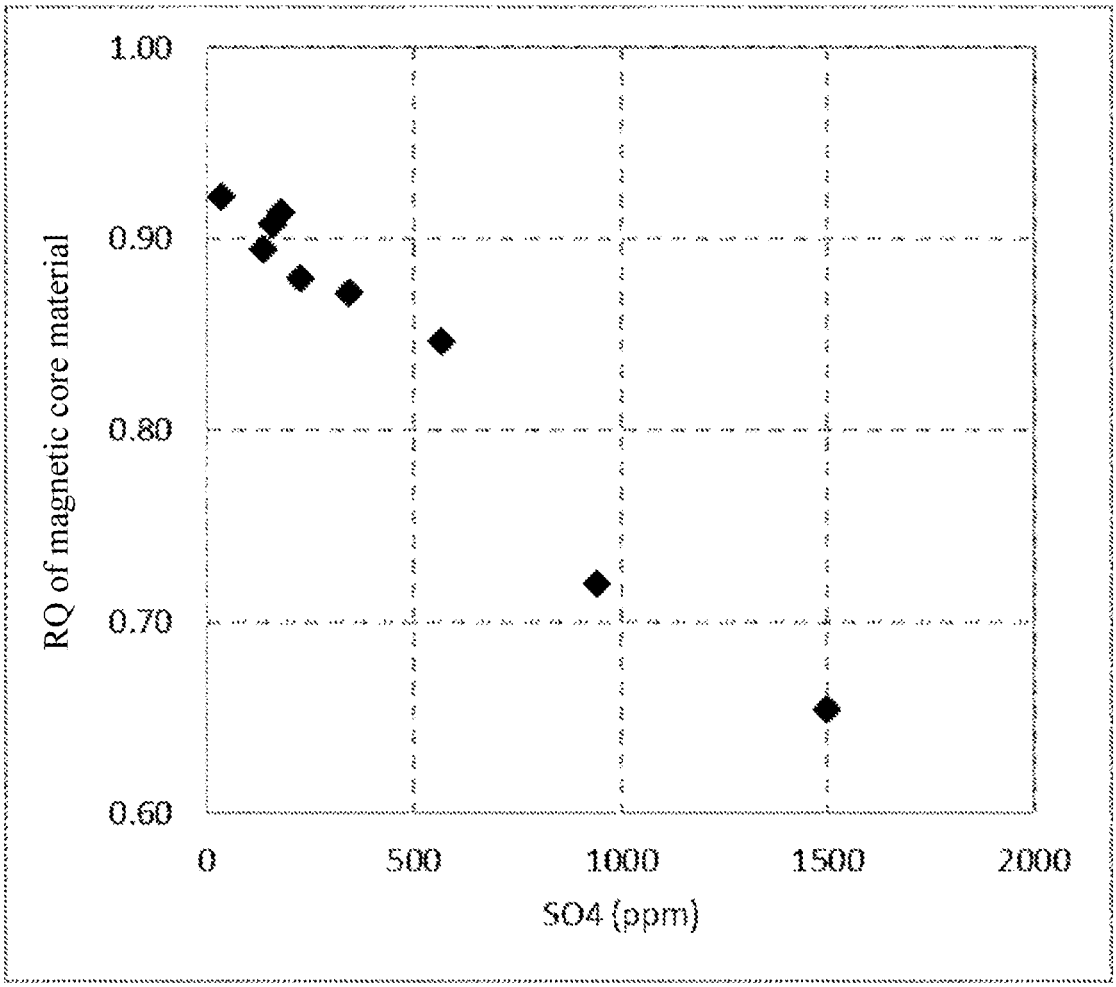
1.00
0.90
0.80
0.70
0.60
RQ of magnetic core material
0
500
1000
1500
2000
SO4 (ppm)

MAGNETIC CORE MATERIAL FOR ELECTROPHOTOGRAPHIC DEVELOPER, CARRIER FOR ELECTROPHOTOGRAPHIC DEVELOPER, AND DEVELOPER

CROSS-REFERENCE TO RELATED APPLICATIONS

This application is a U.S. National Stage entry of PCT Application No: PCT/JP2018/000875 filed on Jan. 15, 2018, which claims priority to Japanese Patent Application No. 2017-023596, filed Feb. 10, 2017, the contents of which are incorporated herein by reference.

TECHNICAL FIELD

The present invention relates to a magnetic core material for electrophotographic developer, a carrier for electrophotographic developer, and a developer.

BACKGROUND ART

The electrophotographic development method is a method in which toner particles in a developer are made to adhere to electrostatic latent images formed on a photoreceptor to develop the images. The developer used in this method is classified into a two-component developer composed of a toner particle and a carrier particle, and a one-component developer using only a toner particle.

As a development method using the two-component developer composed of a toner particle and a carrier particle among those developers, a cascade method and the like were formerly employed, but a magnetic brush method using a magnet roll is now in the mainstream. In the two-component developer, a carrier particle is a carrier substance which is agitated with a toner particle in a development box filled with the developer to impart a desired charge to the toner particle, and further transports the charged toner particle to a surface of a photoreceptor to form toner images on the photoreceptor. The carrier particle remaining on a development roll which holds a magnet is again returned from the development roll to the development box, mixed and agitated with a fresh toner particle, and used repeatedly in a certain period.

In the two-component developer, unlike a one-component developer, the carrier particle has functions of being mixed and agitated with a toner particle to charge the toner particle and transporting the toner particle to a surface of a photoreceptor, and it has good controllability on designing a developer. Therefore, the two-component developer is suitable for using in a full-color development apparatus requiring a high image quality, a high-speed printing apparatus requiring reliability for maintaining image and durability, and the like. In the two-component developer thus used, it is needed that image characteristics such as image density, fogging, white spots, gradation, and resolving power exhibit predetermined values from the initial stage, and additionally these characteristics do not vary and are stably maintained during the durable printing period (i.e., a long period of time of use). In order to stably maintain these characteristics, characteristics of a carrier particle contained in the two-component developer need to be stable. As a carrier particle forming the two-component developer, various carrier such as an iron powder carrier, a ferrite carrier, a resin-coated ferrite carrier, and a magnetic powder-dispersed resin carrier have conventionally been used.

Recently, networking of offices progresses, and the time changes from a single-function copying machine to a multifunctional machine. In addition, a service system also shifts from a system where a service person who contracts to carry out regular maintenance and to replace a developer or the like to the time of a maintenance-free system. The demand for further extending the life of the developer from the market is increasing more and more.

Under such circumstances, resin-filled ferrite carriers in which resin is filled in voids of a ferrite carrier core material using porous ferrite particles have been proposed for the intention of reducing the weight of the carrier particles and for the purpose of extending the life of the developer. For example, Patent Literature 1 (JP-A-2014-197040) proposes a resin-filled ferrite carrier core material for electrophotographic developer including porous ferrite particles having an average compression breaking strength of 100 mN or more and a compression breaking strength variation coefficient of 50% or less; and a resin-filled ferrite carrier for electrophotographic developer in which a resin is filled in voids of the ferrite carrier core material. It is described that according to this ferrite carrier, since the carrier particles can expect reduction in weight because of a low specific gravity and have high strength, effects such as excellent durability and achieving long life can be achieved.

On the other hand, it has been also known that trace amounts of elements in the carrier core material deteriorate carrier characteristics. For example, Patent Literature 2 (JP-A-2010-55014) proposes a resin-filled carrier for electrophotographic developer, which is obtained by filling resin in voids of a porous ferrite core material, in which a Cl concentration of the porous ferrite core material measured by an elution method is from 10 to 280 ppm, and the resin contains an amine compound. It is described that according to this carrier, since the Cl concentration of the porous ferrite core material is reduced within a certain range and the amine compound is contained in the filling resin, a charge amount as desired can be obtained and a small change in charge amount due to environmental changes can be achieved. Furthermore, although not related to porous ferrite, Patent Literature 3 (JP-A-2016-25288) proposes a ferrite magnetic material which includes main components containing Fe and additive elements such as Mn and has an average particle size of from 1 to 100 μm, in which the total amount of impurities excluding Fe, additive elements, and oxygen in the ferrite magnetic material is 0.5 mass % or less, and the impurities include at least two or more of Si, Al, Cr, Cu, P, Cl, Ni, Mo, Zn, Ti, sulfur, Ca, Mn, and Sr. It is described that a magnetic carrier using, as a magnetic carrier core material for electrophotographic developer, the ferrite magnetic material in which the influence of the impurities in the raw material is suppressed, has a high magnetic force and exhibits an effect of suppressing carrier scattering.

CITATION LIST

Patent Literature

Patent Literature 1: JP-A-2014-197040
Patent Literature 2: JP-A-2010-55014
Patent Literature 3: JP-A-2016-25288

SUMMARY OF INVENTION

As such, on the one hand, attempts to improve the carrier characteristics by suppressing the contents of trace elements contained in the carrier core material have been known; but on the other hand, further improvement of the carrier characteristics, specifically, charge imparting ability and durability of the carrier, has been desired in response to the demands for high image quality and high-speed printing. In this respect, the porous ferrite core material and the resin-filled carrier containing the same can reduce the mixing stress applied to a toner in a developing machine owing to their unique low specific gravity, can reduce toner spent even during long-term use, and can prolong lifetime of the developer, whereby long-term stability during durable printing can be achieved. However, due to the low specific gravity, there is a weak frictional stress between the toner and the carrier, which leads to a problem that the rising-up property of the charge amount is inferior. That is, as disclosed in Patent Literature 2, although the change in the charge amount due to the environmental variation is controlled due to the reduction of chlorine, the improvement in the rising-up property of the charge amount has not been attained. The rising-up property of the charge amount is an important characteristic for reducing toner scattering and fogging caused by replenished toner, and stable charge rising-up property from beginning to end is also required in long-term use.

As iron oxide that is a raw material of ferrite used in a carrier core material, iron oxide by-produced in a hydrochloric acid pickling step of steel production is generally used, and this iron oxide contains a sulfur component as impurities. However, since the sulfur component has a small inhibition effect on sintering of ferrite and a small corrosion to production equipment, and there exists a reciprocal relationship in that increase in the quality of raw material leads to decrease in economic efficiency, it has been conventionally considered that the sulfur component is not an important quality index of iron oxide.

Now, the present inventors have found that in the magnetic core material for electrophotographic developer, the content of sulfur component and the pore volume are important in an effort for improving charging characteristics and strength. Specifically, they have found that by suitably controlling the sulfur component content in the magnetic core material for electrophotographic developer and the pore volume, the rising-up of charge amount can be improved and at the same time, the compression breaking strength can be increased and the fluctuation thereof (variation of the compression breaking strength of the individual particles of the magnetic core material) can be reduced, and thus a satisfactory image can stably be obtained when being used for a carrier or a developer.

Therefore, an object of the present invention is to provide a magnetic core material for electrophotographic developer which is excellent in rising-up of charge amount while being low in specific gravity, has high compression breaking strength with low fluctuation thereof, and is capable of providing a satisfactory image stably when being used for a carrier or a developer. Another object of the present invention is to provide a carrier for electrophotographic developer and a developer including such a magnetic core material.

According to an aspect of the present invention, there is provided a magnetic core material for electrophotographic developer, having a sulfur component content of from 60 to 800 ppm in terms of a sulfate ion and a pore volume of from 30 to 100 $mm^3/g$.

According to another aspect of the present invention, there is provided a carrier for electrophotographic developer including the magnetic core material for electrophotographic developer and a coating layer made of a resin provided on a surface of the magnetic core material.

According to another aspect of the present invention, there is provided the carrier for electrophotographic developer, further including a resin filled in pores of the magnetic core material.

According to still another aspect of the present invention, there is provided a developer including the carrier and a toner.

BRIEF DESCRIPTION OF DRAWINGS

FIG. 1 It shows a relationship between a sulfur component content and rising-up speed of charge amount (RQ) in a magnetic core material.

DESCRIPTION OF EMBODIMENTS

In the specification, a numerical value range represented by using "to" means a range including numerical values given before and after "to" as a lower limit value and an upper limit value, respectively.

A magnetic core material for electrophotographic developer is a particle usable as a carrier core material, and becomes a magnetic carrier for electrophotographic developer after a resin is coated on the carrier core material. An electrophotographic developer is obtained by including the magnetic carrier for electrophotographic developer and a toner.

Magnetic Core Material for Electrophotographic Developer:

The magnetic core material for a developer for electrophotography (hereinafter, also referred to as "magnetic core material" or "carrier core material" in some cases) of the present invention has a feature that the content of a sulfur component is controlled within a specific range. Specifically, the content of the sulfur component is from 60 to 800 ppm in term's of sulfur ion ($SO_4^{2-}$) in the magnetic core material. According to such a magnetic core material, a carrier having excellent charge imparting ability and strength can be obtained. In the case where the sulfur component content is more than 800 ppm, the rising-up speed of charge amount becomes low. It is considered that this is because the sulfur component easily absorbs moisture, the moisture content in the magnetic core material and carrier increases to decrease the charge imparting ability, and at the time of stirring the carrier and the toner in developer, the sulfur component in the carrier transfers to the toner, thereby lowering the charging ability of the toner. On the other hand, in the case where the sulfur component content is less than 60 ppm, the fluctuation of the compression breaking strength becomes large and the durability of the carrier becomes inferior. It is considered that this is probably because if the sulfur component in the magnetic core material is too small, the effect of inhibiting sintering becomes too small, and the crystal growth rate becomes excessively large during sintering step at the time of producing the magnetic core material. It is presumed that if the crystal growth rate is excessively high, the degree of sintering varies among the particles of the magnetic core material even if the sintering conditions are adjusted so as to obtain the same particle surface property as in the case where the crystal growth rate is appropriate, resulting in a large proportion of particles (magnetic core material) having low strength. In the case where particles of low strength are used as carriers, breakage cracks due to mechanical stress received in the developing machine during durable printing occur, and image defects are caused by a change in electrical characteristics. In addition, in order to produce a magnetic core material having a sulfur component content of less than 60 ppm, it is necessary to use a raw material having high quality (low content of a sulfur component) or to pass through a step for increasing the quality and thus, there is a problem of poor productivity.

The sulfur component content in the magnetic core material is preferably from 80 to 700 ppm, and more preferably from 100 to 600 ppm on a weight basis.

The content of fluorine ion in the magnetic core material is preferably from 0.1 to 5.0 ppm, more preferably from 0.5 to 3.0 ppm, and even more preferably from 0.5 to 2.0 ppm on a weight basis.

The content of sulfur components in the magnetic core material is obtained in terms of a sulfate ion. This does not mean that the sulfur components are limited to that contained in the form of a sulfate ion, and the sulfur components may be contained in the form of elemental sulfur, a metal sulfide, a sulfate ion, other sulfides or the like. The content of sulfur components can be measured by, for example, a combustion ion chromatography method. The combustion ion chromatography method is a technique in which a sample is burned in oxygen-containing gas flow, the gas generated is absorbed in an adsorption solution and then, a halogen or a sulfate ion adsorbed in the adsorption solution is quantitatively analyzed by an ion chromatography method. The technique makes it possible to easily analyze a halogen or sulfur component in ppm order which has been conventionally difficult.

The values of the contents of anion components described in the present specification are values measured by the combustion ion chromatography under the conditions described in Examples described later.

In addition, the contents of cation components in the magnetic core material can be measured by an ion chromatography. The contents of cation components described in the present specification are values measured by an ion chromatography under the conditions described in Examples described later.

The content of magnesium ion in the magnetic core material is preferably from 2.5 to 10.0 ppm, more preferably from 3.0 to 7.0 ppm, and even more preferably from 3.0 to 5.0 ppm on a weight basis.

In addition, the magnetic core material of the present invention has a pore volume of from 30 to 100 $mm^3/g$. In the case where the pore volume is less than 30 $mm^3/g$, weight reduction cannot be achieved. On the other hand, in the case of more than 100 $mm^3/g$, the strength of the carrier cannot be maintained. The pore volume is preferably from 35 to 90 $m^3/g$, and more preferably from 40 to 70 $mm^3/g$.

The pore volume value described in the present specification is a value measured and calculated by using a mercury porosimeter under the conditions described in Examples described later.

The pore volume of the magnetic core material can be adjusted within the above range by controlling the sintering temperature. For example, by increasing the temperature at the time of sintering, the pore volume tends to decrease. The pore volume tends to increase by lowering the temperature at the time of the sintering. In order to set the pore volume within the above range, the sintering temperature is preferably from 1,010° C. to 1,130° C., and more preferably from 1,050° C. to 1,120° C.

As to the magnetic core material, as long as it functions as a carrier core material, the composition thereof is not particularly limited and a conventionally known composition may be used. The magnetic core material typically has a ferrite composition (ferrite particle) and preferably has a ferrite composition containing Fe, Mn, Mg, and Sr. On the other hand, in consideration of the recent trend of the environmental load reduction including the waste regulation, it is desirable that heavy metals such as Cu, Zn and Ni are not contained in a content exceeding inevitable impurities (associated impurities) range.

Particularly preferably, the magnetic core material is one having a composition represented by the formula: $(MnO)_x(MgO)_y(Fe_2O_3)_z$ in which MnO and MgO are partially substituted with SrO. Here, x=35 to 45 mol %, y=5 to 15 mol %, z=40 to 60 mol %, and x+y+z=100 mol %. By setting x to 35 mol % or more and y to 15 mol % or less, magnetization of ferrite is increased and carrier scattering is further suppressed. On the other hand, by setting x to 45 mol % or less and y to 5 mol % or more, a magnetic core having a higher charge amount can be obtained.

This magnetic core material contains SrO in its composition. Inclusion of SrO suppresses generation of low magnetization particles. In addition, together with $Fe_2O_3$, SrO forms a magnetoplumbite ferrite in a form of $(SrO).6(Fe_2O_3)$ or a precursor of a strontium ferrite (hereinafter referred to as an Sr—Fe compound), which is a cubical crystal as represented by $Sr_aFe_bO_c$ (here, $a \geq 2$, $a+b \leq c \leq a+1.5b$) and has a perovskite crystal structure, and forms a complex oxide solid-solved in $(MnO)_x(MgO)_y(Fe_2O_3)_z$ in a spinel structure. This complex oxide of iron and strontium has an effect of improving the charge imparting ability of the magnetic core material in mainly cooperation with magnesium ferrite which is a component containing MgO. In particular, the Sr—Fe compound has a crystal structure similar to that of $SrTiO_3$, which has a high dielectric constant, and thus contributes to high charging capacity of the magnetic core material. The substitution amount of SrO is preferably from 0.1 to 2.5 mol %, more preferably 0.1 to 2.0 mol %, and even more preferably 0.3 to 1.5 mol %, based on the total amount of $(MnO)_x(MgO)_y(Fe_2O_3)_z$. By setting the substitution amount of SrO to 0.1 mol % or more, the effect of containing SrO is further exerted. By setting to 2.5 mol % or less, excessive increases in remanent magnetization and coercive force are suppressed, and as a result, the carrier fluidity becomes better.

The volume average particle diameter ($D_{50}$) of the magnetic core material is preferably from 20 to 50 μm. By setting the volume average particle diameter to 20 μm or more, carrier scattering is sufficiently suppressed. On the other hand, by setting to 50 μm or less, the image quality deterioration due to the decrease in charge imparting ability can further be suppressed. The volume average particle size is more preferably from 25 to 50 μm, and more preferably from 25 to 45 μm.

The apparent density (AD) of the magnetic core material is preferably from 1.5 to 2.1 $g/cm^3$. By setting the apparent density to 1.5 $g/cm^3$ or more, excessive weight reduction of the carrier is suppressed and the charge imparting ability is further improved. On the other hand, by setting to 2.1 $g/cm^3$ or less, the effect of reducing the carrier weight can be made sufficient and the durability is further improved. The apparent density is more preferably from 1.7 to 2.1 $g/cm^3$, and even more preferably from 1.7 to 2.0 $g/cm^3$.

The BET specific surface area of the magnetic core material is preferably from 0.25 to 0.60 $m^2/g$. By setting the BET specific surface area to 0.25 $m^2/g$ or more, a decrease in effective charging area is suppressed and the charge imparting ability is further improved. On the other hand, by setting to 0.60 $m^2/g$ or less, a decrease in compression breaking strength is suppressed. The BET specific surface area is preferably from 0.25 to 0.50 $m^2/g$, and more preferably from 0.30 to 0.50 $m^2/g$.

As to the magnetic core material, the rising-up speed of charge amount (RQ) is preferably 0.75 or more, more preferably 0.80 or more and further preferably 0.85 or more. In the case where the rising-up speed of charge amount of the magnetic core material is 0.75 or more, the charge amount of carrier also rises rapidly and as a result, in the case of forming a developer together with a toner, at an initial stage after toner replenishment, toner scattering and image defects such as fogging are further suppressed.

The charge amount (Q) and the rising-up speed (RQ) thereof can be measured, for example, in the following manner Namely, a sample and a commercially available negatively chargeable toner (cyan toner, manufactured by Fuji Xerox Co., Ltd., for DocuPrint C3530) used in full-color printer are weighed so as to attain the toner concentration of 8.0% by weight and the total weight of 50 g. The sample and toner weighed are exposed under a normal temperature and normal humidity environment of temperature from 20 to 25° C. and relative humidity from 50 to 60% for 12 hours or more. Then, the sample and toner are charged into a 50-cc glass bottle and agitated at a rotation frequency of 100 rpm for 30 minutes to form a developer. On the other hand, as a charge amount measuring apparatus, use is made of an apparatus having a magnet roll including a total 8 poles of magnets (magnetic flux density: 0.1 T) which N poles and S poles are alternately arranged on an inner side of an aluminum bare tube (hereinafter, a sleeve) of a cylindrical shape of 31 mm in diameter and 76 mm in length, and a cylindrical electrode arranged in an outer circumference of the sleeve with a gap of 5.0 mm from the sleeve. On the sleeve is uniformly adhered 0.5 g of the developer and then, while the magnet roll on the inner side is rotated at 100 rpm with the outer-side aluminum bare tube being fixed, a direct current voltage of 2,000 V is applied for 60 seconds between the outer electrode and the sleeve to transfer the toner to the outer-side electrode. At this time, an electrometer (insulation resistance tester, model 6517A, manufactured by Keithley Instruments, Inc.) is connected to the cylindrical electrode to measure the charge amount of the toner transferred. After the elapse of 60 seconds, the voltage applied is shut off, and after the rotation of the magnet roll is stopped, the outer-side electrode is taken out and the weight of the toner transferred to the electrode is measured. From the charge amount measured and the weight of the toner transferred, the charge amount ($Q_{30}$) is calculated. In addition, the charge amount ($Q_2$) is obtained in the same procedure except for changing the agitation time of the sample and the toner to 2 minutes. The rising-up speed of charge amount (RQ) is determined from the formula shown below. As the numeric value is close to 1, it means that the rising-up speed of charge amount is high.

$$RQ=Q_2/Q_{30} \quad \text{[Math. 1]}$$

The average of compression breaking strength (average compression breaking strength: $CS_{ave}$) of the magnetic core material is preferably 100 mN or more, more preferably 120 mN or more, and even more preferably 150 mN or more. The average of compression breaking strength refers to the average of compression breaking strengths of the individual particles in a particle assembly of the magnetic core material. By setting the average compression breaking strength to 100 mN or more, the strength as a carrier is increased, and thus the durability is further improved. Although the upper limit of the average compression breaking strength is not particularly limited, it is typically 450 mN or less.

The variation coefficient of compression breaking strength (compression breaking strength variation coefficient: $CS_{var}$) of the magnetic core material is preferably 40% or less, more preferably 37% or less, and even more preferably 34% or less. The compression breaking strength variation coefficient is an index of the variation of the compression breaking strength of individual particles in a particle assembly of the magnetic core material, and can be obtained by a method described later. By setting the variation coefficient of the compression breaking strength to 40% or less, the proportion occupied by particles with low strength can be lowered, and the strength as a carrier can be increased. Although the lower limit of the compression breaking strength variation coefficient is not particularly limited, it is typically 5% or more.

The average compression breaking strength ($CS_{ave}$) and the compression breaking strength variation coefficient ($CS_{var}$) of the magnetic core material can be measured, for example, as follows. That is, an ultra-small indentation hardness tester (ENT-1100a, produced by Elionix Co., Ltd.) is used for measuring the compression breaking strength. A sample dispersed on a glass plate is set in the tester and subjected to measurement under an environment of 25° C. For the test, a flat indenter with a diameter of 50 μmϕ is used and loaded up to 490 mN at a load speed of 49 mN/s. As a particle to be used for measurement, a particle which is singly present on the measurement screen (lateral 130 μm×length 100 μm) of the ultra-micro indentation hardness tester, has a spherical shape, and of which an average value of a major axis and a minor axis when measured by software attached to ENT-1100a is volume average particle diameter ±2 μm is selected. It is presumed that the particle has broken down when the slope of the load-displacement curve approaches 0, and the load at the inflection point is taken as the compression breaking strength. The compression breaking strengths of 100 particles are measured and the compression breaking strengths of 80 pieces excluding those of 10 particles from each of the maximum value and the minimum value are employed as data to obtain the average compression breaking strength ($CS_{ave}$). Furthermore, the compression breaking strength variation coefficient ($CS_{var}$) is calculated from the following formula by calculating the standard deviation ($CS_{sd}$) for the 80 particles above.

$$CS_{var}(\%)=(CS_{sd}/CS_{ave})\times 100 \quad \text{[Math. 2]}$$

As described above, by controlling the content of the sulfur components to from 60 to 800 ppm in terms of sulfuric acid ion and the pore volume to from 30 to 100 $mm^3/g$, the magnetic core material (carrier core material) for electrophotographic developer of the present invention can provide a carrier which is excellent in charge imparting ability and strength with low specific gravity and with which a satisfactory image free of defects can be obtained. To the present inventor's knowledge, techniques for controlling the sulfur component content and the pore volume have not heretofore been known. For example, Patent Literatures 2 and 3 focus attention on impurities in the carrier core material, but Patent Literature 2 specifies only the Cl concentration and there is no mention about the sulfur components at all. In addition, Patent Literature 3 specifies the total amount of impurities in the ferrite magnetic material, but it is not intended for the porous ferrite core material and there is no disclosure about the pore volume. Furthermore, the document focuses on merely minimizing the total amount of impurities as much as possible and does not teach controlling the content of sulfur components to fall within a specific range.

Carrier for Electrophotographic Developer

The carrier for electrophotographic developer (also simply referred to as carrier in some cases) of the present invention includes the magnetic core material (carrier core material) and a coating layer formed of a resin and provided on a surface of the magnetic core material. Carrier characteristics may be affected by materials present on the carrier surface and properties thereof. Therefore, by surface-coating with an appropriate resin, desired carrier characteristics can precisely be imparted.

The coating resin is not particularly limited. Examples thereof include a fluorine resin, an acrylic resin, an epoxy resin, a polyamide resin, a polyamide imide resin, a polyester resin, an unsaturated polyester resin, a urea resin, a melamine resin, an alkyd resin, a phenol resin, a fluoroacrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin, and the like. In consideration of elimination of the resin due to the mechanical stress during usage, a thermosetting resin is preferably used. Specific examples of the thermosetting resin includes an epoxy resin, a phenol resin, a silicone resin, an unsaturated polyester resin, a urea resin, a melamine resin, an alkyd resin, resins containing them, and the like. The coating amount of the resin is preferably from 0.5 to 5.0 parts by weight with respect to 100 parts by weight of the magnetic core material.

Furthermore, a conductive agent or a charge control agent may be incorporated into the coating resin. Examples of the conductive agent include conductive carbon, an oxide such as titanium oxide or tin oxide, various types of organic conductive agents, and the like. The addition amount thereof is preferably from 0.25 to 20.0% by weight, more preferably from 0.5 to 15.0% by weight, and further preferably from 1.0 to 10.0% by weight, with respect to the solid content of the coating resin. Examples of the charge control agent include various types of charge control agents commonly used for toner, and various types of silane coupling agents. The kinds of the charge control agents and coupling agents usable are not particularly limited, and preferred are a charge control agent such as a nigrosine dye, a quaternary ammonium salt, an organic metal complex, or a metal-containing monoazo dye, an aminosilane coupling agent, a fluorine-based silane coupling agent, and the like. The addition amount of the charge control agent is preferably from 0.25 to 20.0% by weight, more preferably from 0.5 to 15.0% by weight, and further preferably from 1.0 to 10.0% by weight, with respect to the solid content of the coating resin.

The carrier may further contain a resin filled in the pores of the magnetic core material. The filling amount of the resin is desirably from 2 to 20 parts by weight, more desirably from 2.5 to 15 parts by weight, and even more desirably from 3 to 10 parts by weight, based on 100 parts by weight of the magnetic core material. By setting the filling amount of the resin to 2 parts by weight or more, the filling becomes sufficient and control of the charge amount by the resin coating becomes easy. On the other hand, by setting the filling amount of resin to 20 parts by weight or less, the occurrence of particle aggregation at the time of filling, which causes a change in the charge amount in long-term use, is suppressed.

The filling resin is not particularly limited and can be selected as appropriate depending on the toner to be combined, the environment of usage and the like. Examples thereof include a fluorine resin, an acrylic resin, an epoxy resin, a polyamide resin, a polyamide imide resin, a polyester resin, an unsaturated polyester resin, a urea resin, a melamine resin, an alkyd resin, a phenol resin, a fluoroacrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin, and the like. In consideration of elimination of the resin due to the mechanical stress during usage, a thermosetting resin is preferably used. Specific examples of the thermosetting resin includes an epoxy resin, a phenol resin, a silicone resin, an unsaturated polyester resin, a urea resin, a melamine resin, an alkyd resin, and resins containing them.

For the purpose of controlling the carrier characteristics, a conductive agent or a charge control agent may be added to the filling resin. The types and add amount of the conductive agent and charge control agent are the same as those in the coating resin. In the case where a thermosetting resin is used, an appropriate amount of a curing catalyst may be added as appropriate.

Examples of the catalyst include titanium diisopropoxy bis(ethyl acetoacetate), and the add amount thereof is preferably from 0.5% to 10.0% by weight, more preferably from 1.0% to 10.0% by weight, and even more preferably from 1.0% to 5.0% by weight, in terms of Ti atoms based on the solid content of the coating resin.

The apparent density (AD) of the carrier is preferably from 1.5 to 2.1 g/cm$^3$. By setting the apparent density to 1.5 g/cm$^3$ or more, excessive weight reduction of the carrier is suppressed and the charge imparting ability is further improved. On the other hand, by setting to 2.1 g/cm$^3$ or less, the effect of reducing the carrier weight can be made sufficient and the durability is further improved. The apparent density is more preferably from 1.7 to 2.1 g/cm$^3$, and even more preferably from 1.7 to 2.0 g/cm$^3$.

The rising-up speed of charge amount of the carrier is preferably 0.75 or more, more preferably 0.80 or more, and even more preferably 0.85 or more. By setting the rising-up speed of charge amount to 0.75 or more, in the case of forming a developer together with toner, toner scattering and image defects such as fogging at an initial stage after toner replenishment are further suppressed.

Methods for Producing Magnetic Core Material for Electrophotographic Developer and Carrier for Electrophotographic Developer:

In producing a carrier for electrophotographic developer of the present invention, first, a magnetic core material for electrophotographic developer is produced. For producing the magnetic core material, raw materials are weighed in appropriate amounts, and then pulverized and mixed by a ball mill, a vibration mill or the like for 0.5 hours or more, preferably from 1 to 20 hours. The raw materials are not particularly limited. The pulverized product thus obtained is pelletized by using a pressure molding machine or the like and then calcined at a temperature of from 700 to 1,200° C.

After the calcining, the resulting product is further pulverized with a ball mill, a vibration mill or the like, and then water is added thereto, and a fine-pulverization is carried out by using a bead mill or the like. Next, as necessary, a dispersant, binder or the like are added thereto, and after adjusting the viscosity, granulation is carried out by granulating in a spray dryer. When pulverizing after calcining, water may be added and pulverization may be carried out with a wet ball mill, a wet vibration mill or the like. The pulverizer such as the above-mentioned ball mill, vibration mill, and beads mill is not particularly limited, but in order to effectively and evenly disperse the raw materials, using fine beads having a particle size of 2 mm or less as the medium to be used is preferable. The degree of pulverization can be controlled by adjusting the particle size of the beads to be used, composition, and pulverizing time.

Next, the obtained granulated product is heated at 400 to 800° C. to remove organic components such as added dispersant and binder. If the sintering is performed with the dispersant and binder remaining, the oxygen concentration in the sintering apparatus tends to easily fluctuate due to decomposition and oxidation of the organic components, and the magnetic characteristics are greatly affected, and thus it becomes difficult to stably produce the magnetic core material. In addition, these organic components make it difficult to control the porosity of the magnetic core material, that is, they causes fluctuation in the crystal growth of ferrite.

Thereafter, the obtained granulated product is held at a temperature of from 800 to 1,500° C. for from 1 to 24 hours in an atmosphere in which oxygen concentration is controlled, to thereby carry out sintering. At that time, a rotary electric furnace, a batch electric furnace, a continuous electric furnace, or the like may be used, and oxygen concentration of the atmosphere during sintering may be controlled by introducing an inert gas such as nitrogen or a reducing gas such as hydrogen or carbon monoxide thereinto. Subsequently, the sintered product thus-obtained is disaggregated and classified. As the classification method, the existing method such as an air classification method, a mesh filtration method or a precipitation method is used to regulate the particle size to an intended particle size.

Thereafter, if desired, an oxide film treatment can be performed by applying low temperature heating to the surface, thereby regulating the electric resistance. The oxide film treatment can be performed by heat treatment, for example, at 300 to 700° C. by using a common rotary electric furnace, batch electric furnace or the like. The thickness of the oxide film formed by the treatment is preferably from 0.1 nm to 5 μm. In the case of 0.1 nm or more, the effect of the oxide film layer becomes sufficient. In the case of 5 μm or less, decrease in magnetization and impartment of excessively high resistance can be suppressed. Furthermore, as necessary, reduction may be carried out before the oxide film treatment. As such, porous ferrite particles (magnetic core material) having an average compression breaking strength of a certain level or more and a compression breaking strength variation coefficient of a certain level or less are prepared.

In order to make the average compression breaking strength of the magnetic core material a certain level or more and to make the compression breaking strength variation coefficient a certain level or less, it is desirable to precisely control the calcining condition, the pulverization condition, and the sintering condition. More specifically, the calcining temperature is preferably high. In the case where ferrite formation of the raw materials progresses at the calcining stage, the strain generated in the particle at the sintering stage can be reduced. As for the pulverization condition in the pulverization step after the calcining, long pulverization time is preferable. In the case where the particle diameter of the calcined product in the slurry (suspension containing the calcined product and water) is reduced, external stresses (mechanical stress such as collision, impact and friction between particles, and stress generated between particles) applied in the porous ferrite particles are evenly distributed. As for the sintering condition, long sintering time is preferable. If the sintering time is short, unevenness can be caused in the sintered product, and variation of various physical properties including compression breaking strength is caused.

As the method for adjusting the content of the sulfur component in a magnetic core material, various techniques can be mentioned. Examples thereof include using a raw material having a small sulfur component, and performing washing operation in the stage of slurry before granulation. In addition, it is also effective to increase a flow rate of atmospheric gas introduced into a furnace at the time of calcination or sintering to make the sulfur component be easily discharged outside the system. In particular, the washing operation of slurry is preferably performed, and this can be performed, for example, by a technique in which after dehydration of the slurry, water is added again and wet pulverization is performed. In order to reduce the content of the sulfur component in the magnetic core material, the dehydration and pulverization may be repeated.

As described above, it is desired that after the production of the magnetic core material, the surface of the magnetic core material is coated with a resin to from a carrier. The coating resin used is that described above. As a coating method, a known method, for example, a brush coating method, a dry method, a spray dry system using a fluidized bed, a rotary dry system, or a dip-and-dry method using a universal agitator, can be employed. In order to improve the surface coverage, the method using a fluidized bed is preferred. In the case where the resin is heated after the coating, any of an external heating system and an internal heating system may be employed, and, for example, a fixed or fluidized electric furnace, a rotary electric furnace or a burner furnace can be used. Alternatively, the heating with a microwave may be used. In the case where a UV curable resin is used as the coating resin, a UV heater is employed. The temperature for heating is varied depending on the resin used, but it is desirable to be a temperature equal to or higher than the melting point or the glass transition point. For a thermosetting resin, condensation-crosslinking resin or the like, the temperature is desirably raised to a temperature at which the curing sufficiently progresses.

In producing the carrier of the present invention, as necessary, resin may be filled in the pores of the magnetic core material before the resin coating step. As the filling method, various methods can be used. Examples of the method include a dry method, a spray dry method using a fluidized bed, a rotary dry method, a dip-and-dry method using a universal agitator, and the like. The resin used here is as described above.

In the step of filling the resin, it is preferable that the pores of the magnetic core material is filled with resin while mixing and stirring the magnetic core material and the filling resin under reduced pressure. By filling resin under reduced pressure as such, the pores can effectively filled with the resin. The degree of the decompression is preferably from 10 to 700 mmHg By setting to 700 mmHg or less, the effect of decompression can sufficiently be achieved. On the other hand, by setting to 10 mmHg or more, boiling of the resin solution during the filling step is suppressed, thereby allowing efficient filling. During the resin filling step, the filling can be accomplished by only one time of filling. However, depending on the type of resin, aggregation of particles may occur when attempting to fill a large amount of resin at a time. In such a case, by filling the resin separately in multiple times, filling can be realized without excess or deficiency while preventing aggregation.

After filling the resin, as necessary, heating is carried out by various methods to bring the filled resin into close contact with the core material. As the heating method, either an external heating method or an internal heating method may be used, and for example, a fixed or flow electric furnace, a rotary electric furnace, or a burner furnace can be used. Heating with microwave is also employable. Although the temperature varies depending on the resin to be filled, setting the temperature to equal to or higher than the melting point or glass transition point is desirable, and for a thermosetting resin, condensation-crosslinking resin or the like, the temperature is desirably raised to a temperature at which the curing sufficiently progresses.

Developer

The developer according to the present invention contains the carrier for electrophotographic developer described above and a toner. The particulate toner (toner particle) constituting the developer includes a pulverized toner particle produced by a pulverizing method and a polymerized toner particle produced by a polymerization method. The toner particle used in the present invention may be toner particles obtained by any method. The average particle diameter of the toner particles is in the range of preferably from 2 to 15 μm, and more preferably from 3 to 10 μm. By setting the average particle diameter to 2 μm or more, the charging ability is improved, and fogging and toner scattering are further suppressed. On the other hand, by setting to 15 μm or less, the image quality is further improved. The mixing ratio of the carrier and the toner, that is, the toner concentration is preferably set to 3 to 15% by weight. By setting the toner concentration to 3% by weight or more, a desired image density can be easily obtained. By setting to 15% by weight or less, toner scattering and fogging are further suppressed. On the other hand, in the case where the developer is used as a replenishment developer, the mixing ratio of the carrier and the toner may be from 2 to 50 parts by weight of the toner with respect to 1 part by weight of the carrier.

The developer according to the present invention prepared as described above can be used in a copying machine, a printer, a FAX machine, a printing machine, and the like, which use a digital system employing a development system in which an electrostatic latent image formed on a latent image holder having an organic photoconductive layer is reversely developed with a magnetic brush of a two-component developer containing a toner and a carrier while applying a bias electric field. Furthermore, the developer is also applicable to a full-color machine and the like using an alternative electric field, which is a method in which when applying a development bias from a magnetic brush to an electrostatic latent image side, an AC bias is superimposed on a DC bias.

EXAMPLE

The present invention will be described more specifically with reference to the examples below.

Example 1

(1) Preparation of Magnetic Core Material (Carrier Core Material)

The raw materials were weighed so as to be 38 mol % of MnO, 11 mol % of MgO, 50.3 mol % of $Fe_2O_3$, and 0.7 mol % of SrO, and pulverized and mixed for 4.5 hours with a dry media mill (vibration mill, ⅛ inch diameter stainless steel beads), and the obtained pulverized product was made into pellets of about 1 mm square by a roller compactor. Used were 17.2 kg of $Fe_2O_3$ as a raw material, 6.2 kg of triman-ganese tetraoxide as an MnO raw material, 1.4 kg of magnesium hydroxide as an MgO raw material and 0.2 kg of strontium carbonate as an SrO raw material.

(1-1) Pulverization of Calcined Product

Coarse powder was removed from this pellet by using a vibration screen with an opening of 3 mm, then fine powder was removed by using a vibration screen with an opening of 0.5 mm and then, calcining was carried out by heating in a rotary electric furnace at 1,080° C. for 3 hours.

Next, after pulverizing to an average particle diameter of about 4 μm by using a dry media mill (vibration mill, ⅛ inch diameter stainless steel beads), water was added thereto, and further pulverization was carried out by using a wet media mill (horizontal bead mill, 1/16 inch diameter stainless steel beads) for 5 hours. The resulting slurry was squeezed and dehydrated by a filter press machine, water was added to the cake, and pulverization was carried out by using the wet media mill (horizontal bead mill, 1/16 inch diameter stainless steel beads) again for 5 hours to obtain Slurry 1. The particle size (volume average particle diameter of the pulverized material) of the particles in Slurry 1 was measured by Microtrack, and $D_{50}$ thereof was found 1.4 μm.

(1-2) Granulation

To Slurry 1 obtained was added PVA (aqueous 20% by weight solution) as a binder in an amount of 0.2% by weight based on the solid content, a polycarboxylic acid dispersant was added so as to attain a slurry viscosity of 2 poise, the granulation and drying were carried out by using a spray drier, and the particle size control of the obtained particles (granulated material) was performed by a gyro shifter. Thereafter, the granulated material was heated at 700° C. for 2 hours by a rotary electric furnace to remove organic components such as the dispersant and the binder.

(1-3) Sintering

Thereafter, the granulated material was held in a tunnel electric furnace at a sintering temperature of 1,098° C. under an atmosphere with an oxygen gas concentration of 0.8% by volume for 5 hours to carry out sintering. At this time, the temperature rising rate was set to 150° C./h and the temperature falling rate was set to 110° C./h. Thereafter, the sintered product was disaggregated with a hammer crusher, further classified with a gyro shifter and a turbo classifier to adjust the particle size, and subjected to magnetic separation to separate a low magnetic force product, thereby obtaining ferrite carrier core material (magnetic core material) formed of porous ferrite particles.

(2) Preparation of Carrier

To 20 parts by weight of a methyl silicone resin solution (4 parts by weight as a solid content because of its resin solution concentration being 20%) was added, as a catalyst, titanium diisopropoxy bis(ethyl acetoacetate) in an amount of 25% by weight based on the resin solid content (3% by weight in terms of Ti atom), and thereto was added 3-aminopropyltriethoxysilane as an aminosilane coupling agent in an amount of 5% by weight based on the resin solid content, to thereby obtain a filling resin solution.

This resin solution was mixed and stirred with 100 parts by weight of the porous ferrite particles obtained in (1-3) at 60° C. under reduced pressure of 6.7 kPa (about 50 mmHg), and while volatilizing toluene, the resin was allowed to penetrate and fill into voids (pores) of the porous ferrite particles. The inside of the vessel was returned to an ordinary pressure, and toluene was almost completely removed while stirring under the ordinary pressure. Thereafter, the porous ferrite particles were taken out from the filling apparatus, placed in a vessel, placed in a hot air heating oven, and subjected to a heat treatment at 220° C. for 1.5 hours.

Thereafter, the product was cooled to room temperature, ferrite particles with the resin cured were taken out, the aggregated particles were disaggregated through a vibration screen having an opening size of 200 mesh, and non-magnetic substances were removed by using a magnetic separator. Thereafter, coarse particles were again removed by the vibration screen having an opening size of 200 mesh, to obtain ferrite particles filled with resin.

Next, a solid acrylic resin (BR-73, produced by Mitsubishi Rayon Co., Ltd.) was prepared, 20 parts by weight of this acrylic resin was mixed with 80 parts by weight of toluene and the acrylic resin was dissolved in toluene, to prepare a resin solution. To this resin solution was further added carbon black (Mogul L, produced by Cabot Corporation) as a conductive agent in an amount of 3% by weight based on the acrylic resin, to prepare a coating resin solution.

Resin-filled ferrite particles obtained above were charged into a universal mixing agitator, the acrylic resin solution was added thereto, and resin coating was carried out by a dip-and-dry method. At this time, the acrylic resin was set to be 1% by weight based on the weight of the ferrite particles after filling the resin. After coating, heating was carried out at 145° C. for 2 hours, then the aggregated particles were disaggregated through a vibration screen having an opening size of 200 mesh, and the non-magnetic substances were removed by using a magnetic separator. Thereafter, coarse particles were again removed with the vibration screen having an opening size of 200 mesh, to thereby obtain a resin-filled ferrite carrier having a surface coated with a resin.

(3) Evaluation

As to the magnetic core material and carrier obtained, evaluations of various characteristics were made in the manner described below.

<Volume Average Particle Size>

The volume average particle size ($D_{50}$) of the magnetic core material was measured by using a micro-track particle size analyzer (Model 9320-X100, produced by Nikkiso Co., Ltd.). Water was used as a dispersion medium. First, 10 g of a sample and 80 ml of water were put into a 100-ml beaker and a few drops of a dispersant (sodium hexametaphosphate) was added thereto. Subsequently, the mixture was dispersed for 20 seconds by using an ultrasonic homogenizer (UH-150 Model, produced by SMT. Co., Ltd.) at an output power level set at 4. Thereafter, foams formed on a surface of the beaker were removed, and the sample was loaded in the analyzer to perform the measurement.

<Apparent Density>

The apparent densities (AD) of the magnetic core material and carrier were measured in accordance with JIS Z2504 (Test Method for Apparent Density of Metal Powders).

<Pore Volume>

The pore volume of the magnetic core material was measured by using mercury porosimeters (Pascal 140 and Pascal 240, produced by Thermo Fisher Scientific Inc.). A dilatometer CD3P (for powder) was used, and a sample was put in a commercially available gelatin capsule with a plurality of bored holes and the capsule was placed in the dilatometer. After deaeration in Pascal 140, mercury was charged, and a measurement in the low pressure region (0 to 400 kPa) was performed. Next, a measurement in the high pressure region (from 0.1 MPa to 200 MPa) was performed by Pascal 240. After the measurements, the pore volume of the ferrite particle was determined from data (the pressure and the mercury intrusion amount) for pore diameter of 3 μm or less converted from pressure. For determining the pore diameter, a control-cum-analysis software (PASCAL 140/240/440) associated with the porosimeter was used, and the calculation was carried out with the surface tension of mercury set at 480 dyn/cm and the contact angle set at 141.3°.

<BET Specific Surface Area>

The BET specific surface area of the magnetic core material was measured by using a BET specific surface area measuring apparatus (Macsorb HM model 1210, produced by Mauntec Corporation). A measurement sample was placed in a vacuum dryer, treated at 200° C. for 2 hours, held in the dryer until the temperature reached 80° C. or lower, and then taken out of the dryer. Thereafter, the sample was filled densely in a cell and set in the apparatus. The pre-treatment was carried out at a degassing temperature of 200° C. for 60 minutes and then measurement was carried out.

<Ion Content (Ion Chromatography)>

The measurement of the content of cation components in the magnetic core material was performed in the following manner. First, to 1 g of ferrite particle (magnetic core material) was added 10 ml of ultrapure water (Direct-Q UV3, produced by Merck), and ultrasonic wave was irradiated for 30 minutes to extract the ion components. Next, the supernatant of the extract obtained was filtered with a disposable disc filter (W-25-5, pore size: 0.45 μm, produced by Tosoh Corp.) for a pre-treatment, to form a measurement sample. Then, the contents of the cation components included in the measurement sample were quantitatively analyzed by ion chromatography under the conditions described below and converted to the content ratio in the ferrite particle.

Analysis equipment: IC-2010, produced by Tosoh Corp.
Column: TSKgel SuperIC-Cation HSII (4.6 mm I.D.×1 cm+4.6 mm I.D.×10 cm)
Fluent: Solution prepared by dissolving 3.0 mmol of methanesulfonic acid and 2.7 mmol of 18-crown 6-ether in 1 L of pure water
Flow rate: 1.0 mL/min
Column temperature: 40° C.
Injection volume: 30 μL
Measurement mode: Non-suppressor system
Detector: CM detector
Standard sample: Cation mixed standard solution produced by Kanto Chemical Co., Inc.

On the other hand, the measurement of the contents of anion components was performed by quantitative analysis of the contents of the anion components included in the ferrite particles with a combustion ion chromatography under the conditions described below.

Combustion equipment: AQF-2100H, produced by Mitsubishi Chemical Analytic Tech Co., Ltd.)
Sample amount: 50 mg
Combustion temperature: 1,100° C.
Combustion time: 10 minutes
Ar flow rate: 400 ml/min
$O_2$ flow rate: 200 ml/min
Humidified air flow rate: 100 ml/min
Absorption solution: Solution prepared by adding 1% by weight of hydrogen peroxide to the eluent described below
Analysis equipment: IC-2010, produced by Tosoh Corp.
Column: TSKgel SuperIC-Anion HS (4.6 mm I.D.×1 cm+4.6 mm I.D.×10 cm)
Eluent: Aqueous solution prepared by dissolving 3.8 mmol of $NaHCO_3$ and 3.0 mmol of $Na_2CO_3$ in 1 L of pure water
Flow rate: 1.5 mL/min Column temperature: 40° C.
Injection volume: 30 μL
Measurement mode: Suppressor system
Detector: CM detector
Standard sample: Anion mixed standard solution produced by Kanto Chemical Co., Inc.

<Charge Amount and Rising-Up Speed Thereof>

The measurement of the charge amount (Q) of the magnetic core material and carrier and the rising-up speed (RQ) thereof were performed in the following manner. First, a sample and a commercially available negatively chargeable toner (cyan toner for DocuPrint C3530, produced by Fuji Xerox Co., Ltd.) used in full-color printer were weighed so as to attain the toner concentration of 8.0% by weight and the total weight of 50 g. The sample and toner weighed were exposed under the normal temperature and normal humidity environment of temperature from 20 to 25° C. and humidity from 50 to 60% for 12 hours or more. Then, the sample and toner were charged into a 50-cc glass bottle and agitated at a rotation frequency of 100 rpm for 30 minutes to form a developer. On the other hand, as a charge amount measuring apparatus, use was made of an apparatus having a magnet roll including a total of 8 poles of magnets (magnetic flux density: 0.1 T) which N poles and S poles were alternately arranged on an inner side of an aluminum bare tube (hereinafter, a sleeve) of a cylindrical shape of 31 mm in diameter and 76 mm in length, and a cylindrical electrode arranged in an outer circumference of the sleeve with a gap of 5.0 mm from the sleeve. On the sleeve was uniformly adhered 0.5 g of the developer and then, while the magnet roll on the inner side was rotated at 100 rpm with the outer-side aluminum bare tube being fixed, a direct current voltage of 2,000 V was applied for 60 seconds between the outer electrode and the sleeve to transfer the toner to the outer-side electrode. At this time, an electrometer (an insulation resistance tester, Model 6517A, produced by Keithley Instruments, Inc.) was connected to the cylindrical electrode to measure the charge amount of the toner transferred. After the elapse of 60 seconds, the voltage applied was shut off, and after the rotation of the magnet roll was stopped, the outer-side electrode was taken out and the weight of the toner transferred to the electrode was measured. From the charge amount measured and the weight of the toner transferred, the charge amount ($Q_{30}$) was calculated. In addition, the charge amount ($Q_2$) was obtained in the same procedure except for changing the agitation time of the sample and the toner to 2 minutes. The rising-up speed of charge amount (RQ) was determined from the formula shown below.

$$RQ=Q_2/Q_{30} \quad \text{[Math. 3]}$$

<Compression Breaking Strength>

The average compression breaking strength ($CS_{ave}$) and the compression breaking strength variation coefficient ($CS_{var}$) of the magnetic core material were determined as follows. First, an ultra-small indentation hardness tester (ENT-1100a, produced by Elionix Co., Ltd.) was used, a sample dispersed on a glass plate was set in the tester and subjected to measurement of the compression breaking strength under an environment of 25° C. For the test, a flat indenter with a diameter of 50 μmϕ was used and loaded up to 490 mN at a load speed of 49 mN/s. As a particle to be used for the measurement, a particle which was singly present on the measurement screen (lateral 130 μm×length 100 μm) of the ultra-micro indentation hardness tester, had a spherical shape, and of which an average value of a major axis and a minor axis when measured by software attached to ENT-1100a was volume average particle diameter ±2 μm was selected. It was presumed that the particle had broken down when the slope of the load-displacement curve approached 0, and the load at the inflection point was taken as the compression breaking strength. The compression breaking strengths of 100 particles were measured and the compression breaking strengths of 80 pieces excluding those of 10 particles from each of the maximum value and the minimum value were employed as data to obtain the average compression breaking strength ($CS_{ave}$). Furthermore, the compression breaking strength variation coefficient ($CS_{var}$) was calculated from the following formula by calculating the standard deviation ($CS_{sd}$) for the 80 particles above.

$$CS_{var}(\%)=(CS_{sd}/CS_{ave})\times 100 \quad \text{[Math. 4]}$$

Example 2

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 5 hours. The resulting slurry was dehydrated by a vacuum filter, water was added to the cake, and pulverization was carried out by using the wet media mill (horizontal bead mill, 1/16 inch diameter stainless steel beads) again for 5 hours to obtain Slurry 2. The particle size (volume average particle diameter of the pulverized material) contained in Slurry 2 was measured by Microtrack, and $D_{50}$ thereof was found 1.4 μm.

Example 3

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 5 hours. The resulting slurry was dehydrated by a centrifugal dehydrator, water was added to the cake, and pulverization was carried out by using the wet media mill (horizontal bead mill, 1/16 inch diameter stainless steel beads) again for 5 hours to obtain Slurry 3. The particle size (volume average particle diameter of the pulverized material) of the particles contained in Slurry 3 was measured by Microtrack, and $D_{50}$ thereof was found 1.4 μm.

Example 4

The preparation of magnetic core material and carrier and the evaluations were performed in the same manner as in Example 1, except for using a raw material of a different lot in producing the magnetic core material.

Example 5 (Comparative Example)

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 10 hours, to obtain Slurry 5. The particle size (volume average particle diameter of the pulverized material) of the particles contained in Slurry 5 was measured by Microtrack, and $D_{50}$ thereof was found 1.4 μm.

Example 6 (Comparative Example)

The preparation of magnetic core material and carrier and the evaluations were performed in the same manner as in Example 5, except for using a raw material of a different lot in producing the magnetic core material.

Example 7 (Comparative Example)

The preparation of magnetic core material and carrier and the evaluations were carried out in the same manner as in Example 1 except that the pulverization conditions of the calcined product were changed upon producing the magnetic core material. Here, the (1-1) pulverization of calcined product of Example 1 was changed as follows. That is, after pulverizing to an average particle diameter of about 4 μm by using a dry media mill (vibrating mill, ⅛ inch diameter stainless steel beads), water was added to the obtained product, and further pulverization was carried out by using a wet media mill (horizontal bead mill, 1/16 inch diameter stainless steel beads) for 4 hours. The resulting slurry was squeezed and dehydrated by a filter press machine, water was added to the cake, and pulverization was carried out by using the wet media mill (horizontal bead mill, 1/16 inch diameter stainless steel beads) again for 3 hours. The resulting slurry was squeezed and dehydrated by the filter press machine, water was added to the cake, and pulverization was carried out by using the wet media mill (horizontal bead mill, 1/16 inch diameter stainless steel beads) again for 4 hours, to obtain Slurry 7. The particle size (volume average particle diameter of the pulverized material) of the particles contained in Slurry 7 was measured by Microtrack, and $D_{50}$ thereof was found 1.4 μm.

Example 8 (Comparative Example)

The preparation of magnetic core material and carrier and the evaluations were carried out in the same manner as in Example 1 except that the sintering temperature at the (1-3) sintering was changed to 1,138° C. in producing the magnetic core material and the amount of the methyl silicone resin solution in the filling resin solution was changed to 10 parts by weight (2 parts by weight as solid content) in producing the carrier.

Example 9 (Comparative Example)

The preparation of magnetic core material and carrier and the evaluations were carried out in the same manner as in Example 1 except that the sintering temperature at the (1-3) sintering was changed to 1,000° C. in producing the magnetic core material and the amount of the methyl silicone resin solution in the filling resin solution was changed to 40 parts by weight (8 parts by weight as solid content) in producing the carrier.

Results

In Examples 1 to 9, the evaluation results obtained were as shown in Tables 1 and 2. In Examples 1 to 4, which are Inventive Examples, the magnetic core materials had excellent charge amounts ($Q_2$, $Q_{30}$) and compression breaking strength ($CS_{ave}$), and had large rising-up speed of charge amount (RQ) and small variation coefficient of compression breaking strength ($CS_{var}$). Furthermore, the carriers also had excellent charge amounts ($Q_2$, $Q_{30}$) and large rising-up speed of charge amount (RQ). In Examples 5 and 6, which are Comparative Examples, the magnetic core materials had an excessively high content of the sulfur component ($SO_4$), and as a result, the rising-up speed of charge amount (RQ) was not sufficient. On the other hand, in Example 7, which is Comparative Example, the magnetic core material was an excessively low content of the sulfur component ($SO_4$), and as a result, the variation coefficient of the compression breaking strength ($CS_{var}$) increased. In Example 8, which is Comparative Example, the apparent density (AD) was excessively high because of the small pore volume and, in Example 9, the average compression breaking strength ($CS_{ave}$) was small because of the large pore volume. From these results, it has been found that a magnetic core material for electrophotographic developer and a carrier for electrophotographic developer, which are excellent in charging characteristics and strength with low specific gravity and with which a satisfactory image free of defects can be obtained, and a developer containing the carrier can be provided according to the present invention.

TABLE 1

| | Magnetic core material | | | | | | | | | | | | | | |
|---|---|---|---|---|---|---|---|---|---|---|---|---|---|---|---|
| | $D_{50}$ | AD | Pore volume | BET specific surface area | Ion content (ppm) | | | | | | | | | | |
| | (μm) | (g/cm³) | (mm³/g) | (m²/g) | $F^-$ | $Cl^-$ | $Br^-$ | $NO_2^-$ | $NO_3^-$ | $SO_4^{2-}$ | $Na^+$ | $NH_4^+$ | $Mg^{2+}$ | $Ca^{2+}$ | $K^+$ |
| Ex. 1 | 41.0 | 1.94 | 49 | 0.38 | 0.7 | 12.3 | N.D. | 2.5 | 0.7 | 159 | 16.3 | N.D. | 4.6 | 34.8 | 6.8 |
| Ex. 2 | 40.8 | 1.93 | 47 | 0.36 | 1.1 | 13.9 | N.D. | 2.1 | 0.6 | 345 | 17.6 | N.D. | 4.0 | 33.8 | 6.7 |
| Ex. 3 | 41.4 | 1.93 | 50 | 0.38 | 0.9 | 13.4 | N.D. | 2.2 | 0.6 | 567 | 19.6 | N.D. | 4.3 | 39.0 | 5.9 |
| Ex. 4 | 40.9 | 1.91 | 55 | 0.41 | 0.9 | 52.3 | N.D. | 2.3 | 0.8 | 224 | 15.5 | N.D. | 3.1 | 20.1 | 7.8 |
| Ex. 5* | 40.9 | 1.92 | 56 | 0.41 | 1.0 | 24.9 | N.D. | 2.2 | 0.7 | 941 | 20.6 | N.D. | 4.9 | 50.5 | 6.9 |
| Ex. 6* | 41.3 | 1.94 | 45 | 0.34 | 0.8 | 21.6 | N.D. | 2.3 | 0.7 | 1498 | 17.2 | N.D. | 2.9 | 30.9 | 9.3 |
| Ex. 7* | 41.2 | 1.95 | 43 | 0.35 | 0.7 | 11.1 | N.D. | 2.4 | 0.6 | 33 | 10.8 | N.D. | 3.7 | 31.0 | 6.1 |
| Ex. 8* | 41.1 | 2.14 | 21 | 0.20 | 0.6 | 11.3 | N.D. | 2.5 | 0.7 | 137 | 16.7 | N.D. | 4.4 | 33.3 | 6.2 |
| Ex. 9* | 40.8 | 1.58 | 110 | 0.75 | 1.0 | 12.7 | N.D. | 2.5 | 0.6 | 177 | 17.5 | N.D. | 4.3 | 36.0 | 7.2 |

*indicates Comparative Example.
N.D. stands for "non-detected"

TABLE 2

| | Magnetic core material | | | | | | Carrier | | |
|---|---|---|---|---|---|---|---|---|---|
| | Charge amount | | | Compression breaking strength | | | Charge amount | | |
| | $Q_2$ (μC/g) | $Q_{30}$ (μC/g) | RQ | $CS_{ave}$ (mN) | $CS_{var}$ (%) | AD (g/cm$^3$) | $Q_2$ (μC/g) | $Q_{30}$ (μC/g) | RQ |
| Ex. 1 | 35.2 | 38.8 | 0.91 | 202 | 26 | 1.92 | 32.2 | 35.6 | 0.90 |
| Ex. 2 | 33.4 | 38.3 | 0.87 | 195 | 17 | 1.91 | 29.8 | 34.7 | 0.86 |
| Ex. 3 | 31.9 | 37.7 | 0.85 | 186 | 22 | 1.90 | 29.1 | 34.3 | 0.85 |
| Ex. 4 | 34.9 | 39.7 | 0.88 | 184 | 29 | 1.88 | 32.0 | 35.9 | 0.89 |
| Ex. 5* | 24.7 | 34.3 | 0.72 | 183 | 24 | 1.88 | 21.8 | 30.7 | 0.71 |
| Ex. 6* | 18.9 | 28.9 | 0.65 | 198 | 31 | 1.91 | 16.4 | 24.7 | 0.66 |
| Ex. 7* | 36.4 | 39.5 | 0.92 | 191 | 45 | 1.91 | 33.0 | 36.2 | 0.91 |
| Ex. 8* | 35.7 | 39.9 | 0.89 | 244 | 19 | 2.11 | 32.6 | 35.8 | 0.91 |
| Ex. 9* | 34.1 | 37.3 | 0.91 | 87 | 23 | 1.67 | 30.1 | 35.2 | 0.86 |

*indicates Comparative Example.

INDUSTRIAL APPLICABILITY

According to the present invention, a magnetic core material for electrophotographic developer which is excellent in rising-up of charge amount while being low in specific gravity, has high compression breaking strength with low fluctuation thereof, and is capable of providing a satisfactory image stably when being used for a carrier or a developer, can be provided. Also, another object of the present invention can provide a carrier for electrophotographic developer and the developer including such a magnetic core material.

While the present invention has been described in detail with reference to specific embodiments, it will be apparent to those skilled in the art that various changes and modifications can be made without departing from the spirit and scope of the invention.

This application is based on Japanese Patent Application (No. 2017-023596) filed on Feb. 10, 2017, the contents of which are incorporated herein by reference.

The invention claimed is:

1. A magnetic core material for electrophotographic developer, having a sulfur component content of from 60 to 800 ppm on a weight basis and a pore volume of from 30 to 100 mm3/g, wherein the sulfur content is quantified by detection of sulfate ions.

2. The magnetic core material for electrophotographic developer according to claim 1, wherein the magnetic core material has a ferrite composition comprising Fe, Mn, Mg, and Sr.

3. The magnetic core material for electrophotographic developer according to claim 1, wherein the sulfur component content is from 80 to 700 ppm in terms of a sulfate ion.

4. The magnetic core material for electrophotographic developer according to claim 1, wherein the pore volume of from 35 to 90 mm3/g.

5. A carrier for electrophotographic developer comprising the magnetic core material for electrophotographic developer as described in claim 1 and a coating layer comprising a resin provided on a surface of the magnetic core material.

6. The carrier for electrophotographic developer according to claim 5, further comprising a resin filled in pores of the magnetic core material.

7. A developer comprising the carrier as described in claim 5 and a toner.

8. The magnetic core material for electrophotographic developer according to claim 1, wherein the sulfur content is quantified by ion chromatography detection of sulfate ions.

9. The magnetic core material of claim 2, wherein the ferrite composition is represented by a formula:

$$(MnO)_x(MgO)_y(Fe_2O_3)_z,$$

wherein:

x is from 35 to 45 mol %;

y is from 5 to 1.5 mol %; and z is from 40 to 60 mol %, wherein x, y, and z sum to 100 mol %.

10. The magnetic core material of claim 9, wherein MnO and MgO are partially substituted with SrO, wherein the substitution amount of SrO is 0.1 to 2.5 mol %, based on the total amount of $(MnO)_x(MgO)_y(Fe_2O_3)_z$.

11. The magnetic core material of claim 1, wherein the magnetic core material has an apparent density (AD) that is from 1.5 to 2.1 g/cm$^3$.

12. The magnetic core material of claim 1, wherein a content of fluorine ion in the magnetic core material is from 0.1 to 5.0 ppm on a weight basis.

* * * * *